US006530867B2

(12) United States Patent
Schwendemann

(10) Patent No.: US 6,530,867 B2
(45) Date of Patent: Mar. 11, 2003

(54) MARTIAL ARTS TRAINING SYSTEM

(75) Inventor: Ronald M. Schwendemann, Olathe, KS (US)

(73) Assignee: Fitness Systems, Inc., Olathe, KS (US)

( * ) Notice: Subject to any disclaimer, the term of this patent is extended or adjusted under 35 U.S.C. 154(b) by 0 days.

(21) Appl. No.: 09/854,023

(22) Filed: May 11, 2001

(65) Prior Publication Data

US 2002/0169054 A1 Nov. 14, 2002

(51) Int. Cl.[7] ..... A63B 21/00
(52) U.S. Cl. ..... 482/83; 482/87; 482/90
(58) Field of Search ..... 482/83–90

(56) References Cited

U.S. PATENT DOCUMENTS 1,538,203 A * 5/1925 Moran ..... 482/83
2,153,384 A * 4/1939 Mazza ..... 473/441
2,255,711 A * 9/1941 Noor ..... 473/441
3,424,458 A * 1/1969 Hopps
5,224,912 A * 7/1993 Moody ..... 482/87
5,897,466 A * 4/1999 Capach ..... 482/83
6,348,028 B1 * 2/2002 Cragg ..... 482/148

* cited by examiner

*Primary Examiner*—Jerome W. Donnelly
(74) *Attorney, Agent, or Firm*—Hovey Williams LLP

(57) ABSTRACT

The system includes a tall, open, multi-sided framework having a number of laterally spaced, upright legs that are interconnected by overhead structure in the form of elongated beams. The beams are located above normal human height so as to avoid interference with activities conducted within the open space defined by the framework. A number of trolley-like hangers are adjustably moveable along at least certain of the overhead beams for the purpose of suspending training devices such as kick bags or the like down into the space. Releaseable locks on the hangers are accessible by persons standing beneath the beams to facilitate selective engagement and disengagement of the locks and manual pulling of the hangers along the rails to either deployed positions out in the room space or stored positions adjacent the side of the framework. The framework is constructed in sections using removeable fasteners so as to facilitate on-site erection and disassembly.

24 Claims, 3 Drawing Sheets

MARTIAL ARTS TRAINING SYSTEM

TECHNICAL FIELD

The present invention relates generally to personal training equipment such as that used in the development of martial arts skills and, more particularly, to equipment of the foregoing type that enables the room or other space in which the equipment is placed to be productively used for other purposes when the equipment is not in use, notwithstanding the continued presence of the equipment.

BACKGROUND

Martial arts schools are typically located in rented space within shopping centers and other commercial building structures. The open class room spaces typically found in such areas are conducive to handling sizable groups of students for group exercises and education. However, martial arts also involves considerable resistance training and work on such things as foot and eye coordination, eye and hand coordination, and balance. This frequently involves the use of suspended bags and other devices that can be kicked and struck in the appropriate manner. Rented space is not well-suited for this type of equipment.

For example, the building spaces typically have suspended ceilings that are incapable of supporting the significant loads imposed by hanging the equipment. Further, attachment to rafters and walls may cause extensive shaking and vibration of the building structure, leading to possible damage and, in any event, becoming a nuisance to other tenants. Moreover, any kind of permanent mounting arrangement for the equipment makes its virtually impossible to conduct exercises as a group because the equipment becomes an obstacle. While individual, free-standing bag stands and the like are an option, they still present obstacles that must be dealt with when a free and open class space is desired, and they are not an efficient use of available floor space.

Many individuals are also interested in having personal workout equipment in their own homes or offices. However, conventional equipment occupies such an inordinate amount of floor space and is so inconvenient to move and disassemble that the selected workout area usually needs to be dedicated solely to that one particular purpose. Most homes and offices simply do not have that luxury.

SUMMARY OF THE INVENTION

The present invention provides a workout equipment system, especially but not exclusively suited for martial arts training, that can be quickly and easily placed in either deployed or stowed conditions to allow the room space to be selectively used for a wide variety of different purposes including, but not limited to, workouts and training. It is particularly well-suited for use in a classroom setting where large groups of students are involved. However, the invention is also ideally suited for embodiment in a smaller, home and office use system for individuals.

One preferred embodiment of the present invention contemplates a relatively tall, free-standing, hollow framework or superstructure having a number of upright supporting legs and overhead beams that span and interconnect the legs so as to effectively define an open space under the beams and within the interior of the framework. Carriages or hangers are adjustably moveable along at least certain of the overhead beams to support free-hanging training devices such as kick bags and the like. Each of the hangers can be temporarily locked in any one of a number of selected positions along the length of its supporting beam so as to position one or more of the training devices out within the open space, effectively converting it into a training and skill area. The hangers with their associated training devices can, however, be selectively moved along the overhead beams into stored positions adjacent the outer limits of the framework, such as near a wall of the room, thus freeing up a large open area of the room for group exercises or other group activities. In one particularly preferred form of the invention, the various upright legs and horizontal beams are constructed from end-to-end sections that are bolted together for quick and easy installation and removal.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
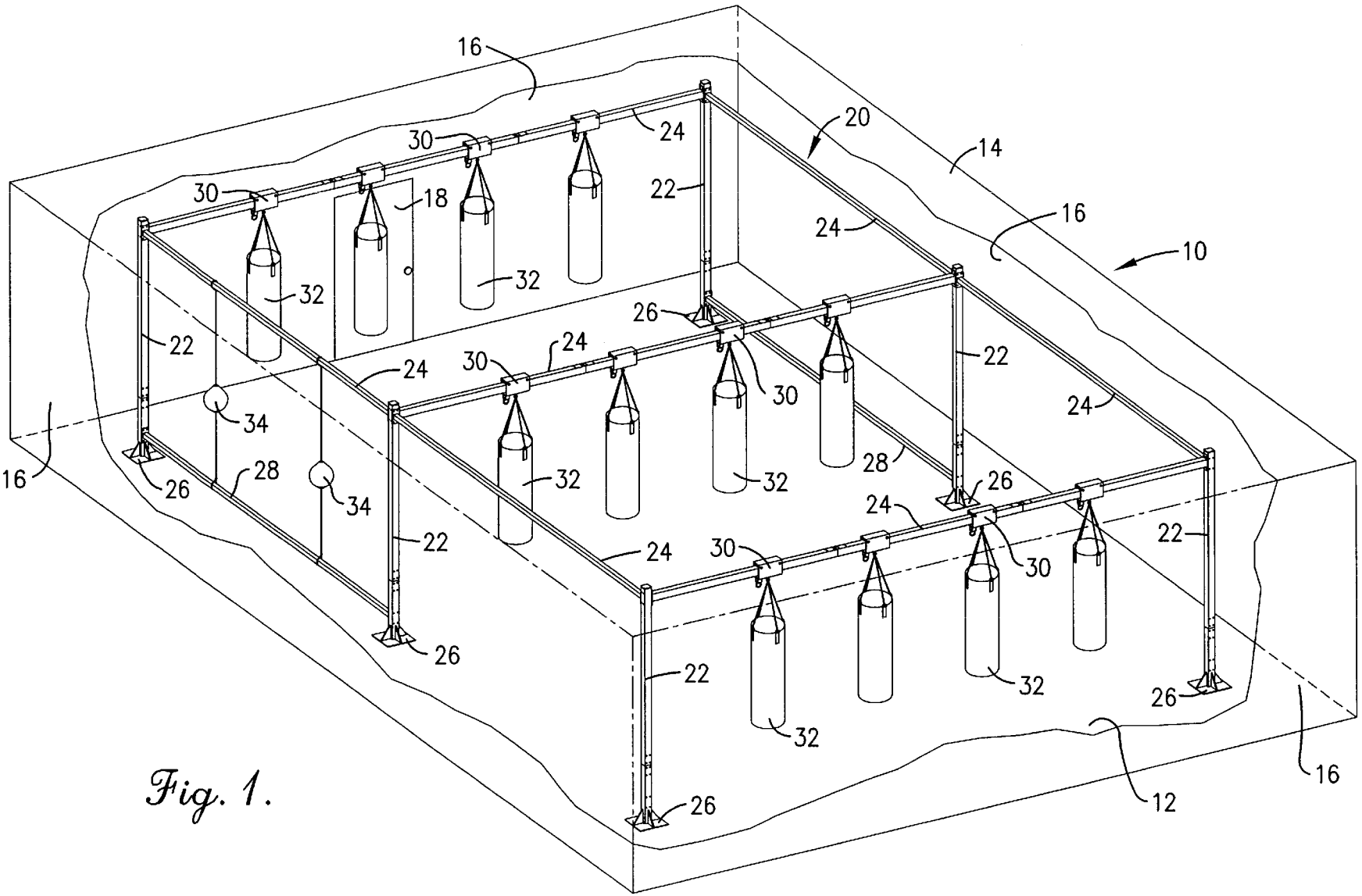
FIG. 1 is an isometric view of a typical room within a building employing a system in accordance with the principles of the present invention, and showing exemplary training devices in deployed positions out in the interior space defined by the framework.

FIG. 1 shows a typical room 10 within the interior of a building, such room having a floor 12, a ceiling 14 and upright walls 16 extending between floor 12 and ceiling 14. A door 18 provides ingress and egress to the space within room 10. By way of example, the room 10 is depicted as being large enough to serve as a classroom for holding a group of students, although it could be a relatively small space suitable for individual use only such as found in the home or office.

In accordance with the present invention, the room 10 is provided with a training system that includes a relatively tall, free-standing, multi-sided open framework 10 including a number of laterally spaced apart, upright legs 22 that are taller than the normal height of persons using the room 10. At the upper ends of legs 22, overhead structure in the nature of a plurality of horizontal beams 24 interconnect the legs 22 to tie the assembly together into a rigid unit that does not rely upon ceiling 14 or walls 16 for support. The lower ends of legs 22 are provided with rectangular, flat feet 26 that are considerably larger in surface area than the cross-sectional area of each leg 22 so as to contribute to the stability of free-standing framework 20. A number of lower horizontal beams 28 near floor 12 may be provided between certain of the legs 22 if desired. In the illustrated embodiment, the framework 20 is rectangular as viewed in plan, although it will be appreciated that a number of other shapes may be obtained and utilized without departing from the principles of the present invention.

Figure 2:
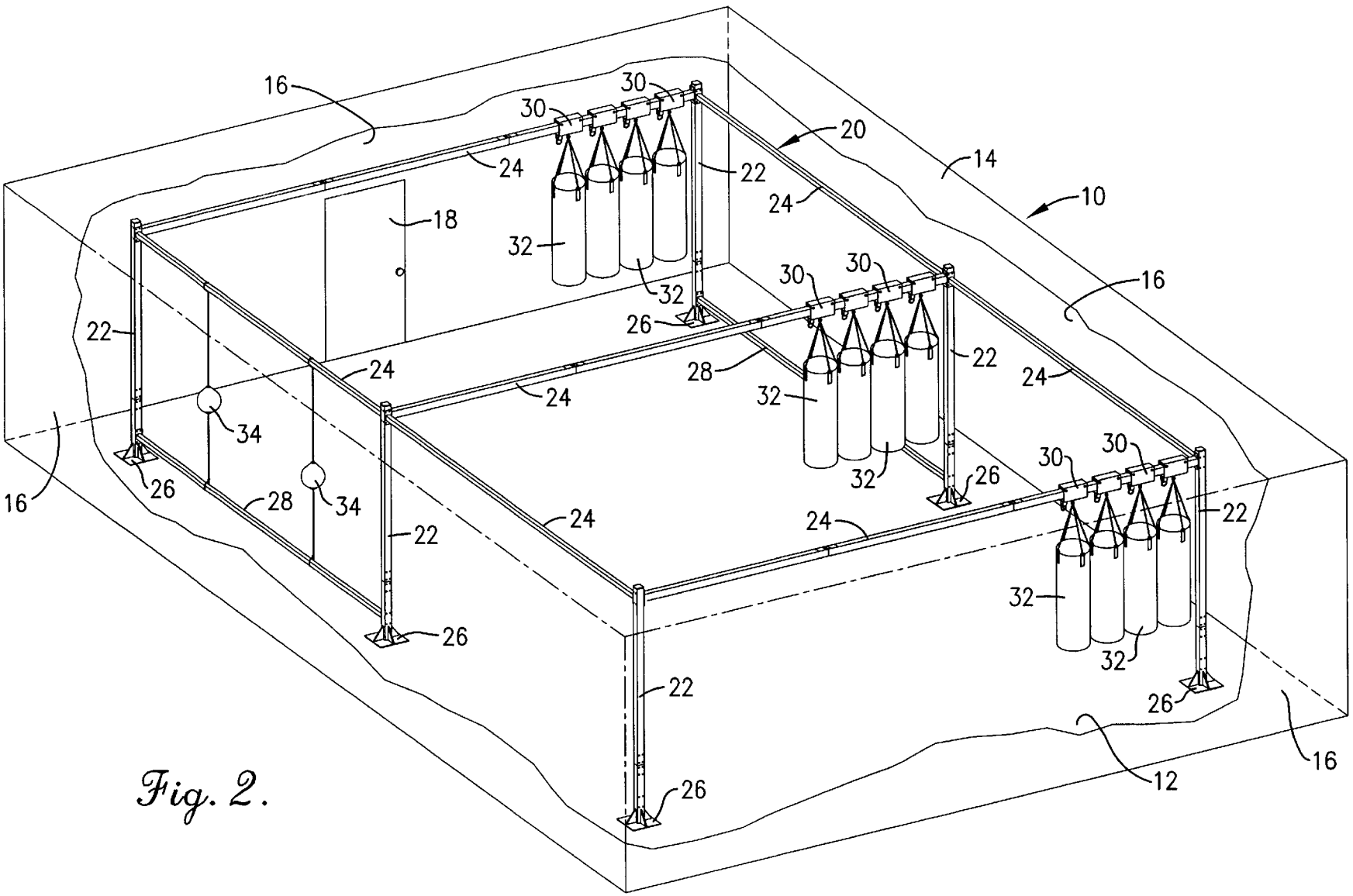
FIG. 2 is an isometric view similar to FIG. 1 but illustrating the training devices collected off to one side of the space so as to free up the area for other types of activities such as, in the illustrated embodiment, exercises and teaching.

At least certain of the upper beams 24 are provided with a series of hangers 30 that are used to suspend training devices such as bags 32 down into the training and class space defined by the interior of the framework 20. Hangers 30 are moveable along their respective beams 24 such that the bags 32 may be deployed as illustrated for example in FIG. 1 in a use position occupying much of the training space, or a stored position as illustrated in FIG. 2 wherein the bags of each beam are collected together in a group adjacent one leg 22 of the framework and one of the walls 16 of the room. When bags 32 are in their stored positions of FIG. 2, the interior space is opened up to provide an essentially unobstructed area. In the case of a class room setting, various types of group exercises and teaching can be carried out in the available space. In the case of the individual home or office, the opened up space (such as in the basement or garage) can be used for any number of different purposes.

It will be noted that, as an option, training devices can also be stretched between the lower beams 28 and corresponding overhead beams 24, as exemplified by the small bags 34 in FIGS. 1 and 2. The lower beams 28 can also be used to support other types of equipment, if desired.

Figure 3:
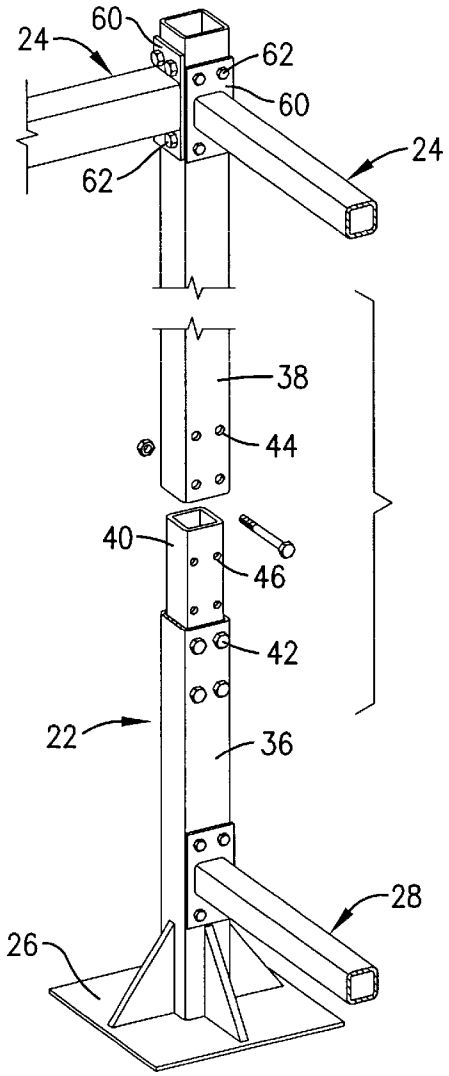
FIG. 3 is an enlarged, fragmentary isometric view of portions of the framework illustrating details of construction.
Figure 3:
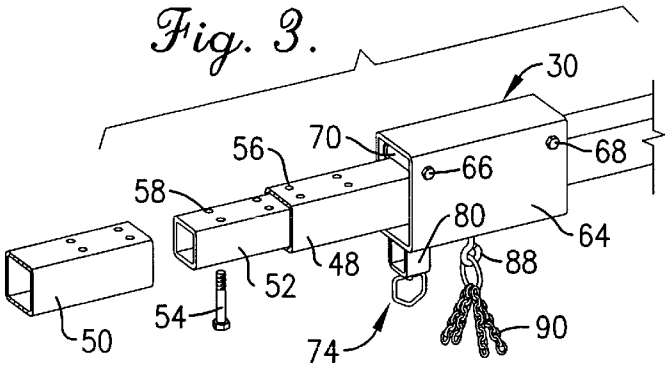

As illustrated in FIG. 3, each of the legs 22 is preferably constructed in sections so that framework 20 may be assembled and erected on-site. As illustrated in FIG. 3, a typical leg 22 includes a tubular lower section 36 and a tubular upper section 38 that are held in end-to-end alignment with one another to present a continuous length for the leg 22. A tubular insert 40 of slightly smaller cross-sectional size than leg 22 but complementary shaped relative thereto is received within leg 22 in such a manner that one half projects up into the upper section 38 while the lower half projects down into the lower section 36. Fasteners in the nature of bolts 42 pass through holes 44 in section 36 and 38 and into corresponding, aligned holes 46 in insert 40 for the purpose of securing the sections 36 and 38 to the common insert 40. Insert 40 and bolts 42 thus serve as a coupling for the two sections 36,38 of each leg 22. To facilitate assembly and erection of the framework 20, the insert 40 could be pre-welded to one of the sections 36, 38, eliminating one set of the bolts 42.

Figure 4:
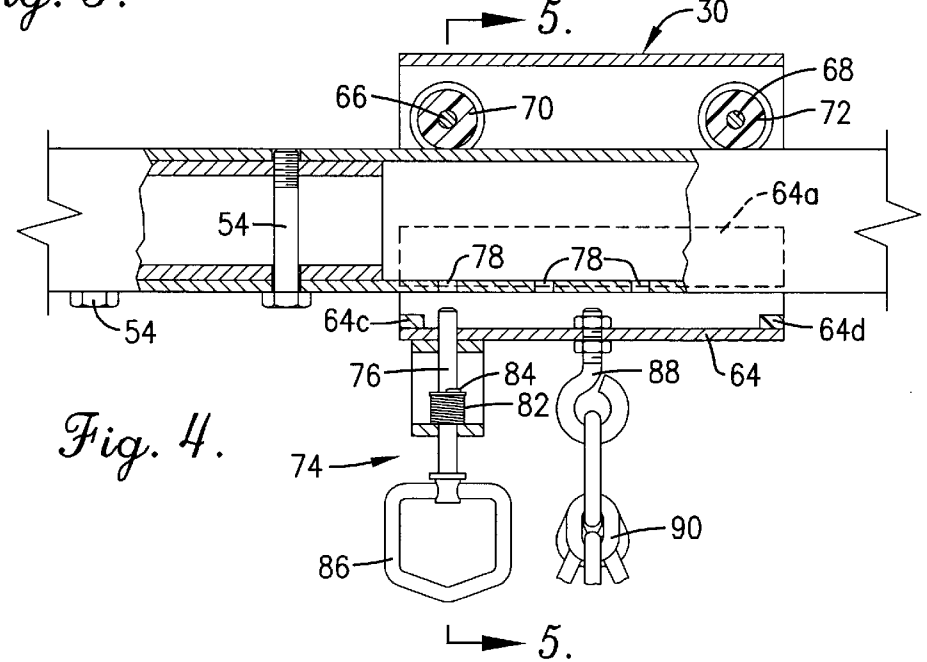
FIG. 4 is a further enlarged fragmentary elevational view of one of the hangers and supporting beams of the framework with parts broken away and shown in cross-section to reveal details of construction.

The upper beams 24 may be constructed similarly to legs 22, as also illustrated particularly in FIGS. 3 and 4. In the particular embodiment illustrated, each of the upper beams 24 that carries a hanger 30 is constructed in three end-to-end sections, two of which are illustrated in FIG. 3 and are denoted by the numerals 48 and 50. A coupling for interconnecting the two sections 48,50 comprises a tubular insert 52 that is slightly smaller in cross-section than the tubular sections 48 and 50 so as to be complementally received with in those structures. One-half of insert 52 projects into section 48, while the other half projects into section 50. Fasteners in the nature of bolts 54 pass through holes 56 in beam sections 48,50 and into holes 58 in insert 52. As perhaps shown best in FIG. 4, the upper holes 58 in insert 52 are threaded so as to threadably receive the upper end of bolt 54, eliminating the need for nuts as used on the legs 22 as shown in FIG. 3. As with the legs 22, the insert 52 could be pre-welded to one of the sections 48, 50 to facilitate assembly and erection.

Opposite ends of each beam 24 are provided with mounting plates 60 that abut the corresponding flat surface of the leg 22 to which the beam 24 is attached. Bolts 62 fasten the mounting plates 60 to the corresponding leg 22. In the illustrated embodiment, the beams 24 that carry hangers 30 are significantly larger in cross-sectional configuration than other beams that do not carry any particular load, as illustrated, for example, in FIG. 3. If desired, all beams could be of the same cross-sectional size and configuration.

Figure 5:
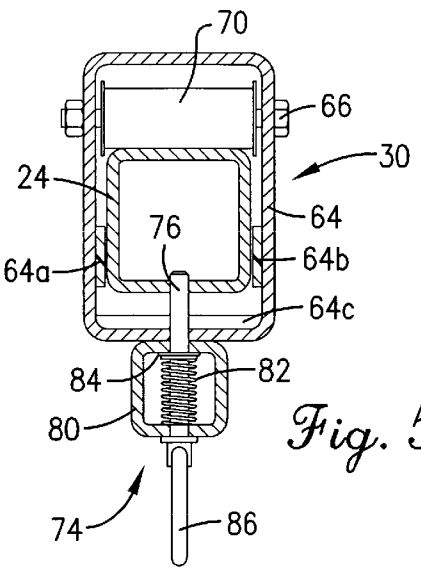
FIG. 5 is a vertical cross-sectional view through the hanger of FIG. 4 taken substantially along line 5—5 of FIG. 4.

As illustrated in FIGS. 3, 4 and 5, each hanger 30 comprises a relatively large, rectangular sleeve 64 that is received on the corresponding beam 24. A pair of bolts 66 and 68 across the upper portions of sleeve 64 and at opposite ends thereof rotatably support a pair of anti-friction rollers 70 and 72 that ride along the top surface of beam 24 to render hangers 30 moveable axially of the beams 24. Longitudinal, Nylon anti-friction guide strips 64*a* and 64*b* on opposite interior walls of sleeve 64 prevent lateral movement on beam 24, while transverse Nylon anti-friction guide strips 64*c* and 64*d* at opposite ends of sleeve 64 help prevent untoward vertical movement relative to beam 24.

Each hanger 30 includes a releaseable lock 74 that is used to temporarily latch the hanger in a selected position along the length of its beam 24. In a preferred embodiment, lock 74 includes a spring-biased pin 76 on sleeve 64 that is yieldably urged toward the bottom of beam 24 for reception within any one of a number of locking holes 78 along the bottom of beam 24. Pin 76 is carried by a hollow bracket 80 fixed to the bottom of sleeve 64, there being a compression spring 82 within bracket 80 that urges pin 76 toward the beam 24. A clip 84 inside of bracket 80 and fixed to pin 76 traps spring 82 against the lower interior surface of bracket 80. For convenience, pin 76 may be provided with a pull ring 86 at its lower end to facilitate gripping and actuation by a person standing within the interior of framework 20 below the beams 24. A suitable strap or pull rope (not shown) may be tied to ring 86 to facilitate release of pin 76 and to provide a convenient way for the user to pull the unlocked hanger along beam 24.

Each sleeve 64 also includes an eye bolt 88 that is fixed to the bottom of sleeve 64 and projects downwardly therefrom. Eye bolt 88 may be used to secure the suspension chains 90 or other hanging means for bags 32 to the hanger 30.

In use of the invention, it will be appreciated that the system can be relatively quickly and easily erected at a selected site without requiring any modification to existing floors, walls and ceilings. Although it is not absolutely essential that the framework 20 be totally free-standing, and it is within the concepts of the present invention to provide additional stabilizing structures if desired, there is no need for such supplemental stabilizing means in order to enjoy the benefits of the invention. By virtue of the fact that framework 20 is comprised of a number of component parts that are secured together by releaseable fasteners, framework 20 can be readily erected on-site in a fairly short period of time and arranged to take on virtually any desired configuration. Although a simple rectangular overall configuration has been illustrated in one preferred embodiment, other shapes that will satisfy the specific needs and desires of the user are within the scope of the present invention.

It will be appreciated that when all of the bags 32 or other training devices are moved off to the side in stored positions as illustrated in FIGS. 2, the space within room 10 is largely unobstructed by the system. Because the overhead beams 24 are disposed at a height significantly above normal human height, they present no obstruction whatever to activity therebeneath. Although the upright legs 22 occupy a certain amount of floor space at eye level, as do the bags 32, the space occupied by those structures is minimal compared to the open space available within the room.

It will be appreciated further that it is not necessary for all of the bags 32 to be either stored or deployed. Depending upon the activities or use planned, such as for a classroom setting, only a few of the bags 32 might be positioned out in the space for training use by a relatively few number of students, while the rest of the area remains open and free for group exercises and the like. Or, the reverse situation could obtain where most of the area is occupied by the bags in a deployed position, while along one end of the area the bags are fully moved over to their stored positions. In any event, it will be appreciated that great flexibility is afforded by the present invention while at the same time avoiding the significant costs and other problems associated with modifying or reconstructing the walls, ceiling or floor of the room.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor(s) hereby state(s) his/their intent to rely on the doctrine of equivalents to determine and assess the reasonably fair scope of his/their invention as pertains to any apparatus not materially departing from but outside the literal scope of the invention as set out in the following claims.

What is claimed is:

1. In combination with the inside of a building having a floor, a ceiling spaced above the floor, and horizontally spaced upright walls extending between the floor and the ceiling, a training system comprising:

a free-standing, multi-sided, upright, open framework that includes a group of upright, horizontally spaced legs supported by the floor and overhead structure interconnecting the legs adjacent upper ends thereof to present an open space within the framework that is generally bounded at the sides by the legs and at the top by the overhead structure; and a plurality of hangers for suspending training articles from the overhead structure and down into the space, said hangers being adjustably movable on the overhead structure for selectively placing the training articles in deployed or stored positions, each of said hangers having a releasable lock for releasably and rigidly securing the hanger in a selected position on the overhead structure against movement relative to the overhead structure, each of said locks being disposed for manual actuation from the floor.

2. The combination as claimed in claim 1, said overhead structure including a plurality of generally horizontal beams, at least certain of said beams having hangers supported thereon.

3. The combination as claimed in claim 2, said lock including a pin yieldably biased toward a locking position engaging the beam, the beam having a hole that removably receives the pin when the pin is in its locking position.

4. The combination as claimed in claim 3, each of said hangers including a set of anti-friction rollers engaging the beam to facilitate adjusting movement of the hanger.

5. The combination as claimed in claim 1, said lock including a pin yieldably biased toward a locking position engaging the overhead structure, the overhead structure having a hole that removably receives the pin when the pin is in its locking position.

6. The combination as claimed in claim 5, each of said hangers including a set of anti-friction rollers engaging the overhead structure to facilitate adjusting movement of the hanger.

7. The combination as claimed in claim 1, said legs and said overhead structure being detachably interconnected to permit assembly and disassembly of the framework.

8. The combination as claimed in claim 7, each of said legs including a pair of end-to-end tubular sections and a coupling detachably securing the sections together.

9. The combination as claimed in claim 8, said coupling including a tubular insert projecting into both sections of the leg, and fasteners detachably securing the sections to the common insert.

10. A training system comprising:

a free-standing, multi-sided, upright, open framework that includes a group of upright, horizontally spaced legs adapted to be supported by the floor inside of a building and overhead structure interconnecting the legs adjacent upper ends thereofto present an open space within the framework that is generally bounded at the sides by the legs and at the top by the overhead structure;

a plurality of hangers mounted on said overhead structure; and a plurality of training articles suspended from said hangers into the class space, said hangers being adjustably movable on the overhead structure for selectively placing the training articles in deployed or stored positions, each of said hangers having a releasable lock for releasably and rigidly securing the hanger in a selected position on the overhead structure against movement relative to the overhead structure, each of said locks being disposed for manual actuation from below the overhead structure.

11. A system as claimed in claim 10, said overhead structure including a plurality of generally horizontal beams, at least certain of said beams having hangers supported thereon.

12. A system as claimed in claim 11, said lock including a pin yieldably biased toward a locking position engaging the beam, the beam having a hole that removably receives the pin when the pin is in its locking position.

13. A system as claimed in claim 12, each of said hangers including a set of anti-friction rollers engaging the beam to facilitate adjusting movement of the hanger.

14. A system as claimed in claim 10, said lock including a pin yieldably biased toward a locking position engaging the overhead structure, the overhead structure having a hole that removably receives the pin when the pin is in its locking position.

15. A system as claimed in claim 14, each of said hangers including a set of anti-friction rollers engaging the overhead structure to facilitate adjusting movement of the hanger.

16. A system as claimed in claim 10;

said legs and said overhead structure being detachably interconnected to permit assembly and disassembly of the framework.

17. A system as claimed in claim 16, each of said legs including a pair of end-to-end tubular sections and a coupling detachably securing the sections together.

18. A system as claimed in claim 17, said coupling including a tubular insert projecting into both sections of the leg, and fasteners detachably securing the sections to the common insert.

19. A method for use in martial arts training comprising the steps of:

providing a room within a building;

erecting a free-standing framework within the room to present a training space within the framework that is large enough and tall enough to accommodate a number of persons, said framework having a plurality of upright legs at spaced locations around the room that are taller than normal human height, said framework further including a plurality of overhead horizontal beams above normal human height that interconnect the legs to rigidify the framework;

suspending a number of training devices from hangers on at least certain of the beams at spaced positions within the training space so that the training devices are accessible to persons being trained; and moving at least certain of the hangers and their training devices along the beams to alternate positions to provide open class space within the framework, said suspending step including temporarily and rigidly locking the hangers in their selected positions on the beams, said moving step including manually unlocking the hangers while positioned below the horizontal beams.

20. A method as claimed in claim 19, said moving step including collecting a number of the training devices into a group adjacent one of the legs of the framework.

21. A method as claimed in claim 20, said moving step including collecting all of the training devices into a plurality of groups adjacent respective legs of the framework.

22. The combination as claimed in claim 1, each of said locks including a locking component that renders the lock released when the component is manually pulled and serves as a device by which the unlocked hanger may be pulled along the overhead structure.

23. A system as claimed in 10, each of said locks including a locking component that renders the lock released when the component is manually pulled and serves as a device by which the unlocked hanger may be pulled along the overhead structure.

24. A method as claimed in claim 19, said moving step including pulling the hangers along the beams while using the same pulling force to maintain the hangers unlocked.

* * * * *